US009566500B2

(12) United States Patent
Chun

(10) Patent No.: US 9,566,500 B2
(45) **Date of Patent: *Feb. 14, 2017**

(54) GAMING TABLE SYSTEM PERMITTING PLAY OF A SHARED PLAYER HAND BY MULTIPLE PLAYERS

(71) Applicant: IGT, Las Vegas, NV (US)

(72) Inventor: Jay Chun, Hong Kong (HK)

(73) Assignee: IGT, Las Vegas, NV (US)

( * ) Notice: Subject to any disclaimer, the term of this patent is extended or adjusted under 35 U.S.C. 154(b) by 193 days.

This patent is subject to a terminal disclaimer.

(21) Appl. No.: 14/320,904

(22) Filed: Jul. 1, 2014

(65) Prior Publication Data

US 2015/0024818 A1 Jan. 22, 2015

Related U.S. Application Data

(63) Continuation of application No. 13/948,101, filed on Jul. 22, 2013, now Pat. No. 8,821,239.

(51) Int. Cl.
*A63F 1/00* (2006.01)
*G07F 17/32* (2006.01)
(Continued)

(52) U.S. Cl.
CPC ..... *A63F 1/00* (2013.01); *A63F 1/067* (2013.01); *A63F 3/00157* (2013.01);
(Continued)

(58) Field of Classification Search
CPC G07F 17/326; G07F 17/3272; G07F 17/3281; G07F 17/3293; G07F 17/3237; G07F 17/322; A63F 2001/003; A63F 2001/005; A63F 1/00; A63F 1/067; A63F 3/00157; A63F 2003/00164
See application file for complete search history.

(56) References Cited

U.S. PATENT DOCUMENTS 3,708,219 A 1/1973 Forlini et al.
3,998,309 A 12/1976 Mandas et al.
(Continued)

FOREIGN PATENT DOCUMENTS

EP 0478412 4/1992
GB 2403429 7/2006
(Continued)

*Primary Examiner* — Werner Garner
(74) *Attorney, Agent, or Firm* — Neal, Gerber & Eisenberg LLP

(57) ABSTRACT

An electronic gaming table for hosting live table games involving wagers can include a physical surface, a dealer station, a plurality of player terminals, and a table controller. The physical surface permits the play of live table games with a live dealer and physical game components. The dealer station is situated proximate the physical surface and allows the presence of a live dealer who facilitates game play. Player terminals allow live players to play the games and include player terminal processors coupled to player interfaces having input and output devices. A table controller coupled to the player terminals controls various table functions and administers a live table game pitting a first hand against a second hand. Each of multiple live players can make different live game decisions independently based upon the same second hand, wherein resolution of the game varies by player depending upon the different live game decisions.

26 Claims, 7 Drawing Sheets

(51) Int. Cl.
*A63F 3/00* (2006.01)
*A63F 1/06* (2006.01)

(52) U.S. Cl.
CPC ..... *G07F 17/322* (2013.01); *A63F 2001/003* (2013.01); *A63F 2001/005* (2013.01); *A63F 2003/00164* (2013.01); *G07F 17/3272* (2013.01); *G07F 17/3293* (2013.01)

(56) References Cited

U.S. PATENT DOCUMENTS 4,095,795 A 6/1978 Saxton
4,333,715 A 6/1982 Brooks
4,337,945 A 7/1982 Levy
4,448,419 A 5/1984 Telnaes
4,467,424 A 8/1984 Hedges et al.
4,517,558 A 5/1985 Davids
4,607,844 A 8/1986 Fullerton
4,621,814 A 11/1986 Stepan et al.
4,659,182 A 4/1987 Aizawa
4,662,635 A 5/1987 Enokian
4,718,672 A 1/1988 Okada
4,805,907 A 2/1989 Hagiwara
4,856,787 A 8/1989 Itkis
4,858,932 A 8/1989 Keane
4,911,449 A 3/1990 Dickinson et al.
4,912,548 A 3/1990 Shanker et al.
5,086,354 A 2/1992 Bass et al.
5,113,272 A 5/1992 Reamey
5,132,839 A 7/1992 Travis
5,248,142 A 9/1993 Breeding
5,288,081 A 2/1994 Breeding
5,319,491 A 6/1994 Selbrede
5,325,830 A 7/1994 Hammer
5,342,047 A 8/1994 Heidel et al.
5,364,100 A 11/1994 Ludlow et al.
5,376,587 A 12/1994 Buchmann et al.
5,393,061 A 2/1995 Manship et al.
5,456,465 A 10/1995 Durham
5,467,893 A 11/1995 Landis et al.
5,472,194 A 12/1995 Breeding et al.
5,490,670 A 2/1996 Hobert
5,494,296 A 2/1996 Grassa
5,539,547 A 7/1996 Ishii et al.
5,544,892 A 8/1996 Breeding
5,580,055 A 12/1996 Hagiwara
5,580,310 A 12/1996 Orus et al.
5,585,821 A 12/1996 Ishikura et al.
5,586,937 A 12/1996 Menashe
5,588,650 A 12/1996 Eman et al.
5,589,980 A 12/1996 Bass et al.
5,611,730 A 3/1997 Weiss
5,613,909 A 3/1997 Stelovsky
5,618,232 A 4/1997 Martin
5,643,086 A 7/1997 Alcorn et al.
5,655,961 A 8/1997 Acres et al.
5,722,890 A 3/1998 Libby et al.
5,743,523 A 4/1998 Kelly et al.
5,743,798 A 4/1998 Adams et al.
5,745,197 A 4/1998 Leung et al.
5,752,881 A 5/1998 Inoue
5,752,882 A 5/1998 Acres et al.
5,759,103 A 6/1998 Freels et al.
5,762,552 A 6/1998 Vuong et al.
5,764,317 A 6/1998 Sadovnik et al.
5,766,076 A 6/1998 Pease et al.
5,772,509 A 6/1998 Weiss
RE35,864 E 7/1998 Weingardt
5,782,692 A 7/1998 Stelovsky
5,788,574 A 8/1998 Ornstein et al.
5,791,992 A 8/1998 Crump et al.
5,795,225 A 8/1998 Jones et al.
5,797,795 A 8/1998 Takemoto et al.
5,800,268 A 9/1998 Molnick
5,803,451 A 9/1998 Kelly et al.
5,820,459 A 10/1998 Acres et al.
5,820,461 A 10/1998 Pernatozzi
5,830,067 A 11/1998 Graves et al.
5,836,817 A 11/1998 Acres et al.
5,839,730 A 11/1998 Pike
5,839,731 A 11/1998 Feola
5,851,149 A 12/1998 Xidos et al.
5,873,781 A 2/1999 Keane
5,885,085 A 3/1999 Fujita
5,888,136 A 3/1999 Herbert
5,910,046 A 6/1999 Wada et al.
5,911,626 A 6/1999 McCrea, Jr.
5,931,471 A 8/1999 Bonito
5,951,397 A 9/1999 Dickinson
5,956,180 A 9/1999 Bass et al.
5,967,893 A 10/1999 Lawrence et al.
6,001,016 A 12/1999 Walker et al.
6,015,346 A 1/2000 Bennett
6,019,374 A 2/2000 Breeding
6,027,115 A 2/2000 Griswold et al.
6,039,650 A 3/2000 Hill
6,050,895 A 4/2000 Luciano et al.
6,054,969 A 4/2000 Haisma
6,056,641 A 5/2000 Webb
6,059,658 A 5/2000 Mangano et al.
6,080,063 A 6/2000 Khosla
6,083,105 A 7/2000 Ronin et al.
6,113,493 A 9/2000 Walker et al.
6,135,884 A 10/2000 Hedrick et al.
6,142,876 A 11/2000 Cumbers
6,149,522 A 11/2000 Alcorn et al.
6,159,098 A 12/2000 Slomiany et al.
6,165,069 A 12/2000 Sines et al.
6,213,875 B1 4/2001 Suzuki
6,244,596 B1 6/2001 Kondratjuk
6,251,014 B1 6/2001 Stockdale et al.
6,252,707 B1 6/2001 Kleinberger et al.
6,254,481 B1 7/2001 Jaffe
6,264,561 B1 7/2001 Saffari
6,312,334 B1 11/2001 Yoseloff
6,315,666 B1 11/2001 Mastera et al.
6,336,857 B1 1/2002 McBride
6,337,513 B1 1/2002 Clevenger et al.
6,347,996 B1 2/2002 Gilmore et al.
6,368,216 B1 4/2002 Hedrick et al.
6,379,244 B1 4/2002 Sagawa et al.
6,394,907 B1 5/2002 Rowe
6,398,220 B1 6/2002 Inoue
6,416,827 B1 7/2002 Chakrapani et al.
6,435,970 B1 8/2002 Baerlocher et al.
6,444,496 B1 9/2002 Edwards et al.
6,445,185 B1 9/2002 Damadian et al.
6,491,583 B1 12/2002 Gauselmann
6,503,147 B1 1/2003 Stockdale et al.
6,508,709 B1 1/2003 Karmarkar
6,511,375 B1 1/2003 Kaminkow
6,512,559 B1 1/2003 Hashimoto et al.
6,514,141 B1 2/2003 Kaminkow et al.
6,517,073 B1 2/2003 Vancura
6,517,433 B2 2/2003 Loose et al.
6,517,437 B1 2/2003 Wells et al.
6,547,664 B2 4/2003 Saunders
6,575,541 B1 6/2003 Hedrick et al.
6,575,834 B1 6/2003 Lindo
6,585,591 B1 7/2003 Baerlocher et al.
6,607,195 B2 8/2003 Vancura
D480,961 S 10/2003 Deadman
6,646,695 B1 11/2003 Gauselmann
6,652,378 B2 11/2003 Cannon et al.
6,659,864 B2 12/2003 McGahn et al.
6,661,425 B1 12/2003 Hiroaki
6,676,517 B2 1/2004 Beavers
6,685,567 B2 2/2004 Cockerille et al.
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.

(56) References Cited

U.S. PATENT DOCUMENTS 6,726,565 B2 4/2004 Hughs-Baird
6,789,801 B2 9/2004 Snow
6,802,777 B2 10/2004 Seelig et al.
6,804,763 B1 10/2004 Stockdale et al.
6,817,945 B2 11/2004 Seelig et al.
6,817,946 B2 11/2004 Motegi et al.
6,863,608 B1 3/2005 LeMay et al.
6,866,586 B2 3/2005 Oberberger et al.
6,887,157 B2 5/2005 LeMay et al.
6,890,259 B2 5/2005 Breckner et al.
6,906,762 B1 6/2005 Witehira et al.
6,937,298 B2 8/2005 Okada
7,029,395 B1 4/2006 Baerlocher
7,128,647 B2 10/2006 Muir
7,204,753 B2 4/2007 Ozaki et al.
7,220,181 B2 5/2007 Okada
7,252,288 B2 8/2007 Seelig et al.
7,255,643 B2 8/2007 Ozaki et al.
7,303,473 B2 12/2007 Rowe
7,309,284 B2 12/2007 Griswold et al.
7,322,884 B2 1/2008 Emori et al.
7,326,115 B2 2/2008 Baerlocher
7,329,179 B2 2/2008 Baerlocher
7,329,181 B2 2/2008 Hoshino et al.
7,351,146 B2 4/2008 Kaminkow
7,387,570 B2 6/2008 Randall
7,452,270 B2 11/2008 Walker et al.
7,465,227 B2 12/2008 Baerlocher
7,470,185 B2 12/2008 Baerlocher
7,488,251 B2 2/2009 Kaminkow
7,503,849 B2 3/2009 Hornik et al.
7,537,456 B2 5/2009 Snow
7,566,274 B2 7/2009 Johnson et al.
7,575,512 B2 8/2009 Kennedy
7,591,726 B2 9/2009 Baerlocher et al.
7,618,319 B2 11/2009 Casey et al.
7,666,086 B2 2/2010 Baerlocher
7,666,087 B2 2/2010 Hughs-Baird
7,699,698 B2 4/2010 Randall
7,753,798 B2 7/2010 Soltys et al.
7,758,419 B2 7/2010 Rowe et al.
7,775,524 B2 8/2010 Lutnick et al.
7,789,743 B2 9/2010 Walker et al.
7,819,744 B2 10/2010 Hughs-Baird
7,822,641 B2 10/2010 Abbott et al.
7,828,643 B2 11/2010 Baerlocher
7,837,547 B2 11/2010 Cannon
7,846,018 B2 12/2010 Baerlocher
7,867,077 B2 1/2011 Baerlocher et al.
7,878,892 B2 2/2011 Sines et al.
7,905,771 B2 3/2011 Walker et al.
7,905,774 B2 3/2011 Walker et al.
7,914,372 B2 3/2011 Tessmer et al.
7,931,531 B2 4/2011 Oberberger
7,950,993 B2 5/2011 Oberberger
7,963,845 B2 6/2011 Baerlocher
7,967,674 B2 6/2011 Baerlocher
7,976,378 B2 7/2011 Baerlocher
7,980,948 B2 7/2011 Rowe et al.
8,020,866 B2 9/2011 Walker et al.
8,066,564 B2 11/2011 Randall
8,087,999 B2 1/2012 Oberberger et al.
8,109,821 B2 2/2012 Kovacs et al.
8,128,491 B2 3/2012 Vasquez et al.
8,128,492 B2 3/2012 Vasquez et al.
8,152,624 B2 4/2012 Gerrard et al.
8,152,629 B2 4/2012 DeWaal et al.
8,167,711 B2 5/2012 Baerlocher
8,172,660 B2 5/2012 Lancaster et al.
8,177,627 B2 5/2012 Baerlocher
8,182,323 B2 5/2012 Okada
8,197,335 B2 6/2012 DeWaal et al.
8,202,153 B2 6/2012 Baerlocher
8,206,212 B2 6/2012 Iddings et al.
8,231,456 B2 7/2012 Zielinski
8,235,801 B2 8/2012 Tan
8,267,765 B2 9/2012 Baerlocher
8,305,550 B2 11/2012 Jung et al.
8,313,373 B2 11/2012 Walker et al.
8,317,589 B2 11/2012 Tessmer et al.
8,342,954 B2 1/2013 Oberberger et al.
8,360,852 B2 1/2013 Randall
8,360,859 B2 1/2013 Walker et al.
8,403,740 B2 3/2013 Kovacs et al.
8,425,305 B2 4/2013 Baerlocher et al.
8,430,735 B2 4/2013 Oberberger
8,430,739 B2 4/2013 Rodgers
8,454,427 B2 6/2013 Baerlocher
8,460,095 B2 6/2013 Tan
8,474,820 B2 7/2013 Walker et al.
8,485,888 B2 7/2013 Baerlocher
8,496,521 B2 7/2013 Randall
8,500,533 B2 8/2013 Lutnick et al.
8,506,380 B2 8/2013 Hughes et al.
8,517,824 B2 8/2013 Zielinski et al.
8,613,650 B2 12/2013 Kovacs et al.
9,135,775 B2 9/2015 Pececnik
9,214,056 B2 12/2015 Kovacs et al.
2001/0013681 A1 8/2001 Bruzzese et al.
2002/0045472 A1 4/2002 Adams
2002/0068635 A1 6/2002 Hill
2002/0077712 A1 6/2002 Safaei et al.
2002/0094869 A1 7/2002 Harkham
2002/0173354 A1 11/2002 Winans et al.
2003/0027624 A1 2/2003 Gilmore et al.
2003/0032478 A1 2/2003 Takahama et al.
2003/0032479 A1 2/2003 LeMay et al.
2003/0060271 A1 3/2003 Gilmore et al.
2003/0073497 A1 4/2003 Nelson
2003/0087690 A1 5/2003 Loose et al.
2003/0130028 A1 7/2003 Aida et al.
2003/0176214 A1 9/2003 Burak et al.
2003/0203756 A1 10/2003 Jackson
2003/0224854 A1 12/2003 Joao
2003/0234489 A1 12/2003 Okada
2003/0236114 A1 12/2003 Griswold et al.
2003/0236118 A1 12/2003 Okada
2004/0002379 A1 1/2004 Parrott et al.
2004/0023714 A1 2/2004 Asdale
2004/0029636 A1 2/2004 Wells
2004/0063490 A1 4/2004 Okada
2004/0066475 A1 4/2004 Searle
2004/0070146 A1 4/2004 Snow
2004/0084843 A1 5/2004 Snow
2004/0090003 A1 5/2004 Snow
2004/0090005 A1 5/2004 Snow
2004/0116178 A1 6/2004 Okada
2004/0145116 A1 7/2004 Calvo et al.
2004/0147303 A1 7/2004 Imura et al.
2004/0147314 A1 7/2004 LeMay et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0183972 A1 9/2004 Bell
2004/0192430 A1 9/2004 Burak et al.
2004/0198485 A1 10/2004 Loose et al.
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0214635 A1 10/2004 Okada
2004/0214637 A1 10/2004 Nonaka
2004/0224747 A1 11/2004 Okada
2004/0233663 A1 11/2004 Emslie et al.
2004/0239582 A1 12/2004 Seymour
2005/0003886 A1 1/2005 Englman et al.
2005/0032571 A1 2/2005 Asonuma
2005/0037843 A1 2/2005 Wells et al.
2005/0049032 A1 3/2005 Kobayashi
2005/0049046 A1 3/2005 Kobayashi

(56) References Cited

U.S. PATENT DOCUMENTS

| | | | |
|---|---|---|---|
| 2005/0062410 | A1 | 3/2005 | Bell et al. |
| 2005/0063055 | A1 | 3/2005 | Engel |
| 2005/0079913 | A1 | 4/2005 | Inamura |
| 2005/0085292 | A1 | 4/2005 | Inamura |
| 2005/0153772 | A1 | 7/2005 | Griswold et al. |
| 2005/0153775 | A1 | 7/2005 | Griswold et al. |
| 2005/0176493 | A1 | 8/2005 | Nozaki et al. |
| 2005/0176507 | A1 | 8/2005 | Ephrati et al. |
| 2005/0192090 | A1 | 9/2005 | Muir et al. |
| 2005/0192099 | A1 | 9/2005 | Nguyen et al. |
| 2005/0206582 | A1 | 9/2005 | Bell et al. |
| 2005/0208994 | A1 | 9/2005 | Berman |
| 2005/0233799 | A1 | 10/2005 | LeMay et al. |
| 2005/0233803 | A1 | 10/2005 | Yang |
| 2005/0239539 | A1 | 10/2005 | Inamura |
| 2005/0266912 | A1 | 12/2005 | Sekiguchi |
| 2005/0282625 | A1 | 12/2005 | Nicely |
| 2005/0285337 | A1 | 12/2005 | Durham et al. |
| 2006/0030399 | A1 | 2/2006 | Baerlocher |
| 2006/0040733 | A1 | 2/2006 | Baerlocher |
| 2006/0073882 | A1 | 4/2006 | Rozkin et al. |
| 2006/0092170 | A1 | 5/2006 | Bathiche et al. |
| 2006/0100014 | A1 | 5/2006 | Griswold et al. |
| 2006/0103951 | A1 | 5/2006 | Bell et al. |
| 2006/0125745 | A1 | 6/2006 | Evanicky |
| 2006/0135240 | A1 | 6/2006 | Barshack |
| 2006/0166727 | A1 | 7/2006 | Burak |
| 2006/0189382 | A1 | 8/2006 | Muir et al. |
| 2006/0191177 | A1 | 8/2006 | Engel |
| 2006/0258446 | A1 | 11/2006 | Nguyen et al. |
| 2006/0284574 | A1 | 12/2006 | Emslie et al. |
| 2006/0290594 | A1 | 12/2006 | Engel et al. |
| 2007/0004510 | A1 | 1/2007 | Underdahl et al. |
| 2007/0010315 | A1 | 1/2007 | Hein |
| 2007/0021198 | A1 | 1/2007 | Muir et al. |
| 2007/0129123 | A1 | 6/2007 | Eryou et al. |
| 2008/0020816 | A1 | 1/2008 | Griswold et al. |
| 2008/0020839 | A1 | 1/2008 | Wells et al. |
| 2008/0020840 | A1 | 1/2008 | Wells et al. |
| 2008/0020841 | A1 | 1/2008 | Wells et al. |
| 2008/0064467 | A1 | 3/2008 | Reiner |
| 2008/0146344 | A1 | 6/2008 | Rowe et al. |
| 2008/0149705 | A1 | 6/2008 | Giobbi et al. |
| 2008/0182650 | A1 | 7/2008 | Randall et al. |
| 2008/0231611 | A1 | 9/2008 | Bathiche et al. |
| 2008/0248865 | A1 | 10/2008 | Tedesco et al. |
| 2008/0305855 | A1 | 12/2008 | Czyzewski et al. |
| 2008/0318668 | A1 | 12/2008 | Ching et al. |
| 2009/0029766 | A1 | 1/2009 | Lutnick et al. |
| 2009/0111573 | A1 | 4/2009 | Iddings |
| 2010/0111820 | A1 | 5/2010 | Natura et al. |
| 2010/0120506 | A1 | 5/2010 | Davis et al. |
| 2010/0130280 | A1 | 5/2010 | Arezina et al. |
| 2010/0234086 | A1 | 9/2010 | Michaelson |
| 2011/0111824 | A1 | 5/2011 | Cuddy et al. |
| 2012/0004037 | A1* | 1/2012 | Hill ..... G07F 17/32 463/42 |

FOREIGN PATENT DOCUMENTS

| | | |
|---|---|---|
| WO | WO 99/19027 | 4/1999 |
| WO | WO 99/42889 | 8/1999 |
| WO | WO 99/44095 | 9/1999 |
| WO | WO 01/09664 | 2/2001 |
| WO | WO 01/15127 | 3/2001 |
| WO | WO 01/15128 | 3/2001 |
| WO | WO 01/15132 | 3/2001 |
| WO | WO 2004/001486 | 12/2003 |
| WO | WO 2004/102520 | 11/2004 |
| WO | WO 2006/034192 | 3/2006 |
| WO | WO 2006/038819 | 4/2006 |
| WO | WO 2007/032945 | 3/2007 |
| WO | WO 2007/073534 | 6/2007 |

* cited by examiner

GAMING TABLE SYSTEM PERMITTING PLAY OF A SHARED PLAYER HAND BY MULTIPLE PLAYERS

NOTICE OF RELATED APPLICATION

This application is a continuation of co-pending and commonly owned U.S. patent application Ser. No. 13/948,101, which application is incorporated herein in its entirety and for all purposes.

TECHNICAL FIELD

The present invention relates generally to gaming machines, tables and systems, and more particularly to gaming tables having automated components.

BACKGROUND

Wagering games such as baccarat, blackjack, roulette, and various poker-based table games, among many others, are popular games offered in casinos and other similar establishments. These games are generally played on physical gaming tables having a live actual dealer, felt or similar table top layouts, cards, dice, chips and the like, or on electronic gaming machines where the dealer, playing cards, chips or other gaming elements may be virtual. Each of these platforms has a limited capacity for players to participate in any particular game due to a limited number of player positions or a limitation on physical space about the table.

These physical space limitations have led to the introduction and growing popularity of gaming table systems having extended gaming terminals that essentially extend the capacity of a table game to include additional players in the game. These extended or remote gaming terminals can be configured to facilitate the participation of other players in a table game. For example, one popular form of baccarat can allow for the addition of numerous players about or near a physical baccarat table. Such added players are able to follow the action at the nearby table by way of one or more large video screens having a live feed of the gaming action, and can place and resolve wagers and other actions by way of electronic gaming terminals that are able to coordinate with the action at the nearby live gaming table. In such arrangements, dozens or even hundreds of players can wager on a single live baccarat game, such as by wagering on "house," "player," or "tie." The live game with physical cards is then carried about by a live dealer, whereupon a game result is achieved and all active and participating players are credited or deducted based upon their wagers and accounts.

Unfortunately, the arrangement of such large player games does not tend to work as smoothly for games where player choices are involved as a significant feature of the game. In the foregoing baccarat example, it is fairly simple for a player to wager on one of two hands, whereupon the resolution of the hand is mechanical and straightforward in nature according to rigid rules. Other games where player choices can affect the outcome of a hand or play are not as easy to administer with respect to live table games where dozens or hundreds of players participate in a single hand or play. Furthermore, while baccarat tends to involve a single hand against a single hand regardless of the number of players, other types of games often involve each player having his or her own cards or other game components. Blackjack is just one of many types of games where the addition of many more players for a single gaming table is typically difficult to administer as a practical matter.

While electronic gaming tables and gaming table systems have increased the traditionally limited player capacity for live table games, these tables and systems are a fairly recent development and there is always a desire improve the attractiveness and functionality of such systems. What is desired then are improved gaming table systems, particularly with respect to those having the ability to allow many players to participate in live table games while not severely limiting the abilities of players to make active choices with respect to the actual game play.

SUMMARY

It is an advantage of the present disclosure to provide improved gaming table systems, particularly with respect to those having the ability to allow many players to participate in a live table game while still allowing players to make active choices with respect to the actual game play. This can be accomplished at least in part through the use of electronic gaming tables and systems adapted to host live games with live dealers and physical game components, where the table or system permits player choices and resolves game outcomes differently for each player whenever the player choices diverge from each other.

In various embodiments of the present disclosure, an electronic gaming table is adapted to host live table games involving wagers, table games based on the wagers, and monetary awards based on the results of the table games. The electronic gaming table can include a physical surface adapted for the play of live table games that include the use of a live dealer and physical game components, as well as a dealer station situated proximate the physical surface and adapted to provide for the presence of a live dealer who facilitates the play of the live table games. The gaming table can also include a plurality of player terminals situated at or nearby the electronic gaming table, wherein each of the plurality of player terminals provides for the presence of a live player to play said live table games and includes a player terminal processor coupled to a player interface having one or more player input devices and one or more player output devices. In various embodiments, the number of player terminals associated with a single electronic gaming table can be a dozen, several dozen, or even over one hundred. In addition, a table controller can be coupled to the plurality of player terminals and be adapted to control a plurality of electronic gaming table functions, where the table controller is further adapted to administer a live table game pitting a first hand against a second hand. For the game, each of a plurality of live players is permitted to make different live game decisions independently based upon the same second hand, wherein the resolution of the live table game varies by player depending upon the different live game decisions of the plurality of live players.

In various detailed embodiments, the live table game at the electronic gaming table is blackjack, among other possible games. In addition, the electronic gaming table can include at least one interface in communication with the table controller and one or more gaming system components remotely located from said electronic gaming table. Such one or more gaming system components can include a remote server adapted to resolve financial transactions with respect to the table games hosted at the electronic gaming table. The remote server can also serve to process one or more of the functions that might alternatively be administered by the table controller in some embodiments. Such functions can also be performed by multiple servers, which may also serve as special purpose servers, such a video server for broadcasting play actions at other game tables, a game history server, a game search server, a table game remote audit server, an accounting server, a game database server, a social networking server, and the like. In addition, the remote server or servers can be further adapted to resolve financial transactions from other separate electronic gaming tables. This financial transaction mediation service for multiple separate tables can allow a player at a terminal to participate in multiple live table games at any given time. In such an implementation, the financial account(s) of a given player can be debited, credited, or both by multiple separate live game tables, depending on the game resolution or result of each bet placed by a player at each table. Further, each table may be located at a different gaming venue, giving rise to a multi-game, multi-site, and multi-bet gaming environment, making it critical to have a financial mediation and clearinghouse server or servers.

In various detailed embodiments involving the live game played, the first hand can be a house hand for the hosting gaming establishment and the second hand can be a player hand for some or all of the plurality of players. The table controller and/or the remote server can be further adapted to resolve a game play decision with respect to the second hand based upon collective input by the plurality of players. For example, decisions on whether to split a hand can be subject to collective input from all players. Such collective input can comprise a majority decision selected from a plurality of possible game play decisions at a given point in the play of the live table game. In some embodiments, the collective input can comprise a weighted input from each live player in the game, such as where each weighted input is weighted according to the amount wagered by the respective player. In various embodiments, varied resolutions of the live table game for different players can result in different game outcomes. Such different game outcomes can involve different players having more or fewer cards or other game components at the end of the live table game depending upon the different live game decisions of the plurality of players. For example, some players might hit where other players stand. Also, varied resolutions of the live table game for different players can involve the same game outcome but different monetary awards depending upon the different live game decisions of the plurality of players. For example, some players might decide take insurance or double down where appropriate, while others might not do so.

In still further detailed embodiments, at least one community display in communication with the table controller can be adapted to provide a display of the physical components of the table game to live players who are near but not physically at the electronic gaming table. Such a display can be a large overhead display that is visible to many all around the vicinity of the table. Live video feeds can also be used to provide the display to player terminals that are in another room or other location. That is, the plurality of player terminals can include one or more player terminals located remotely from the physical surface. In some embodiments, the table controller is further adapted to interact with one or more third party electronic devices as added virtual player terminals for additional live players to play the table games.

In various further embodiments, an electronic gaming table system can include one or more electronic gaming tables such as that which is set forth above, as well as a host server located remotely from and in communication with each of said one or more electronic gaming tables. The host server can be adapted to facilitate the processing of transactions with respect to table games played at the electronic gaming tables, and may also provide other functionalities rather than the table controllers. For example, the host server can be adapted to resolve a game play decision with respect to the second hand based upon collective input by the plurality of players.

In still further embodiments, various methods of providing a live table game at a gaming table are provided. Pertinent process steps can include, for example, providing a first electronic gaming table, presenting a live table game, permitting separate player decisions regarding and during the play of the live table game, and resolving the game according to the separate decisions. Again, the table can be adapted to host table games involving wagers, table games based on the wagers, and monetary awards based on the results of the table games. A presented live table game can have a live dealer, where a first live player and a second live player located at or near the electronic gaming table both participate in the live table game, which game can pit a first hand against a second hand, the second hand being played by both of the first live player and the second live player. Resolving the live table game for the first live player and the second live player can result in different results for the two players, such as where one elected to stand and the other elected to hit and busted his or her hand. As such, a further step can involve awarding a prize or monetary payout to the first live player but not the second live player based on the different results of the live table game. Other details from the single table and system embodiments above can also apply to the various detailed method embodiments.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed inventive apparatuses and methods for gaming tables and systems allowing choices from numerous players for a single game. These drawings in no way limit any changes in form and detail that may be made to the disclosure by one skilled in the art without departing from the spirit and scope of the disclosure.

DETAILED DESCRIPTION

Figure 1A:
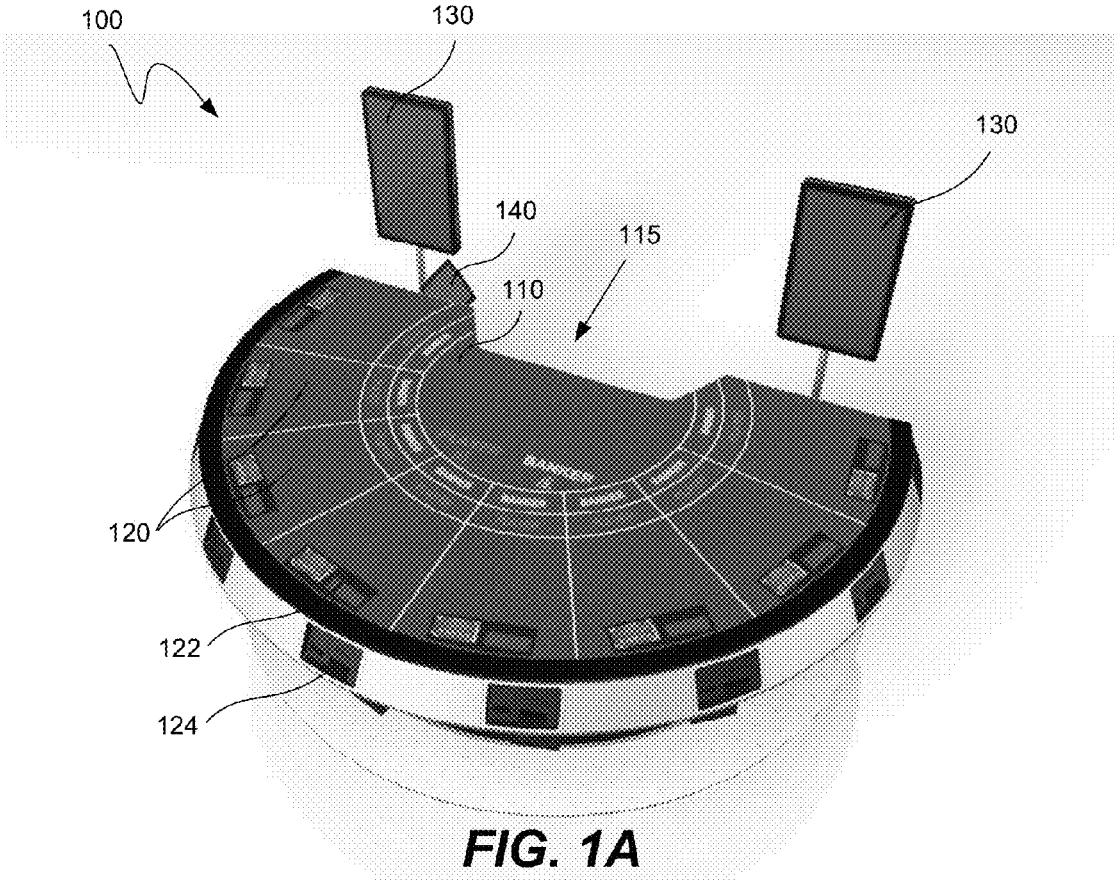
FIGS. 1A and 1B illustrate in top and front perspective views an exemplary electronic gaming table adapted for table games that allow many players while still permitting individual player choices according to one embodiment of the present disclosure.

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to systems and methods for providing, conducting and facilitating the play of wagering games at live electronic gaming tables that can include live dealers, live players, live gaming components, and an electronic platform. This disclosure may be applied to any live table game, such as baccarat, blackjack, roulette, craps, pai gow, sic bo, bingo, card games, and the like, as well as any other type of game having a live or electronic dealer and one or more players seated at a gaming table or electronic gaming platform. The various embodiments disclosed herein can be applied with respect to individual tables, entire systems, and methods of running table games.

As discussed herein, this disclosure may also be applied in a live electronic gaming table system that monitors a live table game in which physical or virtual cards are dealt to one or more players at, near, or associated with a gaming table. Alternatively, or in addition, other physical gaming elements can be employed, such as dice, chips, tokens and the like. The game play data collected is used to enable play of the same live table game remotely through gaming terminals. The gaming terminals may be any platform capable of receiving and transmitting data, including "thin-client" platforms or platforms which do not process game play data and "smart" platforms or platforms which process game play data. The gaming terminal maybe stationary, similar to the slot machines or electronic tables commonly seen at the physical casino, or portable electronic devices such as smart phones, computer tablets, portable media players, laptop computers, desktop computers, smart TV, and the like. Additionally, the respective gaming network can be of wired (Ethernet, Token Ring, Serial multidrop, etc.) or wireless variety (802.11x, BlueTooth, LTE, 2G/3G/4G cellular, Zigbee, Ultra Wide Band, etc.) known in the art. Thus, players interested in placing wagers on a live-table games are not confined to the gaming table or casino floor.

In general, the present disclosure pertains to one table or a system of multiple electronic gaming tables that allows any number of players to play on a single table, while still allowing player choices for each player with respect to the play of the games thereon. In addition, the table or system allows remote player terminals to participate as if the remote player has a seat at the physical table. A relevant electronic gaming table system can include live electronic tables ("eTables"), remote game terminals (electronic gaming machine ("EGM"), smart phone, smart TV, tablet, etc.), a central games repository and server that acquires the available live games from each eTable, indexes them and broadcasts the games and games history to other electronic tables, remote game terminals, and remote gaming sites, a multi-site games traffic server that receives remote game requests, verifies a player's eligibility (location, ID, funds), enforces jurisdictional rules, and routes eligible bets to the player's requested game "channel" being broadcasted, a financial server that acts as a Central Clearinghouse for remote wagers, and a network that connects the electronic tables, remote game terminals, the games repository and router, and the financial clearinghouse server.

A table processor and/or remote server can be used to administer the game, track player decisions and decide game outcomes for each player accordingly. Other components and items may also be present as desired. In addition to the various components, details and other aspects set forth herein with respect to the disclosed gaming table systems and remote gaming in general, further details and explanations regarding remote gaming and table game systems can be found at, for example, U.S. patent application Ser. Nos. 13/893,340; 13/844,617; 13/542,446; 13/456,110; 13/042,633; 11/497,708; 11/312,150; 11/198,218; and 11/042,732, with the entire contents of all of these applications being incorporated herein by reference in their entireties and for all purposes.

Figure 1B:
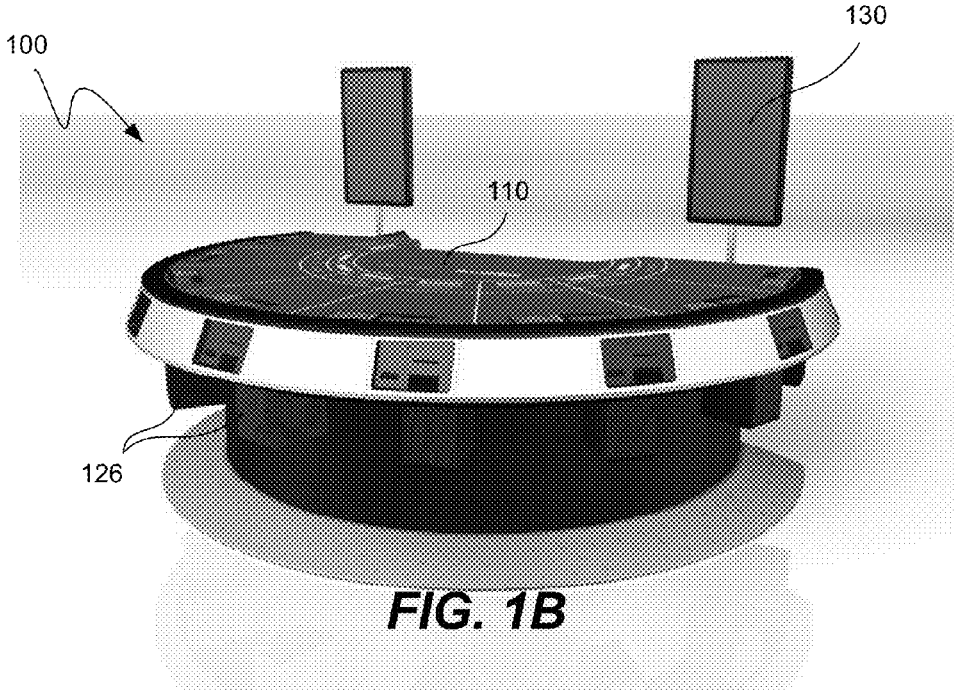

Referring first to FIGS. 1A and 1B, an exemplary electronic gaming table adapted for table games that allow many players while still permitting individual player choices according to one embodiment of the present disclosure is illustrated in top and front perspective views respectively. It will be readily appreciated that this electronic gaming table ("eTable") 100 can also be provided in numerous other configurations and formats, such that the provided example is for illustrative purposes only. The eTable 100 can include include a playing surface 110 adapted for the play of live table games using live physical components, a live dealer station or region 115, a plurality of player stations 120, each of which has its own displays 122, bill acceptor, card acceptor and other input components 124, one or more community displays 130, and a dealer station display and/or computing device 140. One or more physical separators 126 may separate the different player stations 120.

Each player position 120 around the eTable 100 can have a player terminal integrated into it. Like a standalone remote gaming terminal, each player terminal can have its own controller, buttons, touchscreen display, bill validator, printer, card reader, and so forth. The player terminals can be connected to a table controller ("TC") for the entire table via a switch/hub, and the TC connects to an overall local or wide area network, as provided in greater detail below.

Each eTable 100 can be hosted by a live dealer, such as at a dealer station 115. The live dealer deals real cards, one or more roulette wheels, and/or uses real dice or other physical game components, which can be done on a wooden green-felt table surface 110. The cards can be drawn from an electronic shoe ("eShoe"), which is connected to the TC on the local table network. In some embodiments, the eShoe scans the cards and reads the rank and suits for each card removed. The TC, via player login data (such as player tracking card swipe or a cash insertion at the bill acceptor), knows which positions at the table are active and thus can monitor the progress of a game. One or more table sensors, such as a camera, RFID reader, or the like, can be used to capture video of the dealer action for broadcasting, as well as tracking of players and physical game components through a variety of means. The camera can also be used to further verify and keep a log of game activities, such as, for example, cards removed from the eShoe, cards dealt to player positions, bets entered, new players, and the like.

The eTable 100 also has one or more displays. In one embodiment, there can be one or more community displays 130 to show common player information, such as community cards, table wager minimum, casino name, time, advertisements, voting results and resulting game play dispositions, and the like. Game history (e.g., baccarat roadmaps) may also be displayed on the same screen 130 or on a separate screen attached to the eTable 100. Additionally, game histories, trends, patterns and/or statistics from other tables, or even other gaming venues, and other game types, may also be displayed. This can help players in selecting other games that they might also want to play at the same time or to otherwise monitor other games and gaming environment at a given time, such as in the same manner that an investor in the financial stock market monitors the stocks, stock indices, news and other market indicators. In some embodiments, the community display may show other or added information, such as the ranks of top players, popularity of tables (e.g., top tables with the most number of active players), top game types (e.g., roulette, baccarat, black jack, poker, pai gow, mahjong), and so forth. The eTable may also have discrete displays such as On/Off/Flashing lights mounted underneath table graphics to annunciate game information such as Banker Win, Player Win, New Game, No More Bets, and so forth. Such table screens and discrete displays can be driven by the TC.

Figure 2:
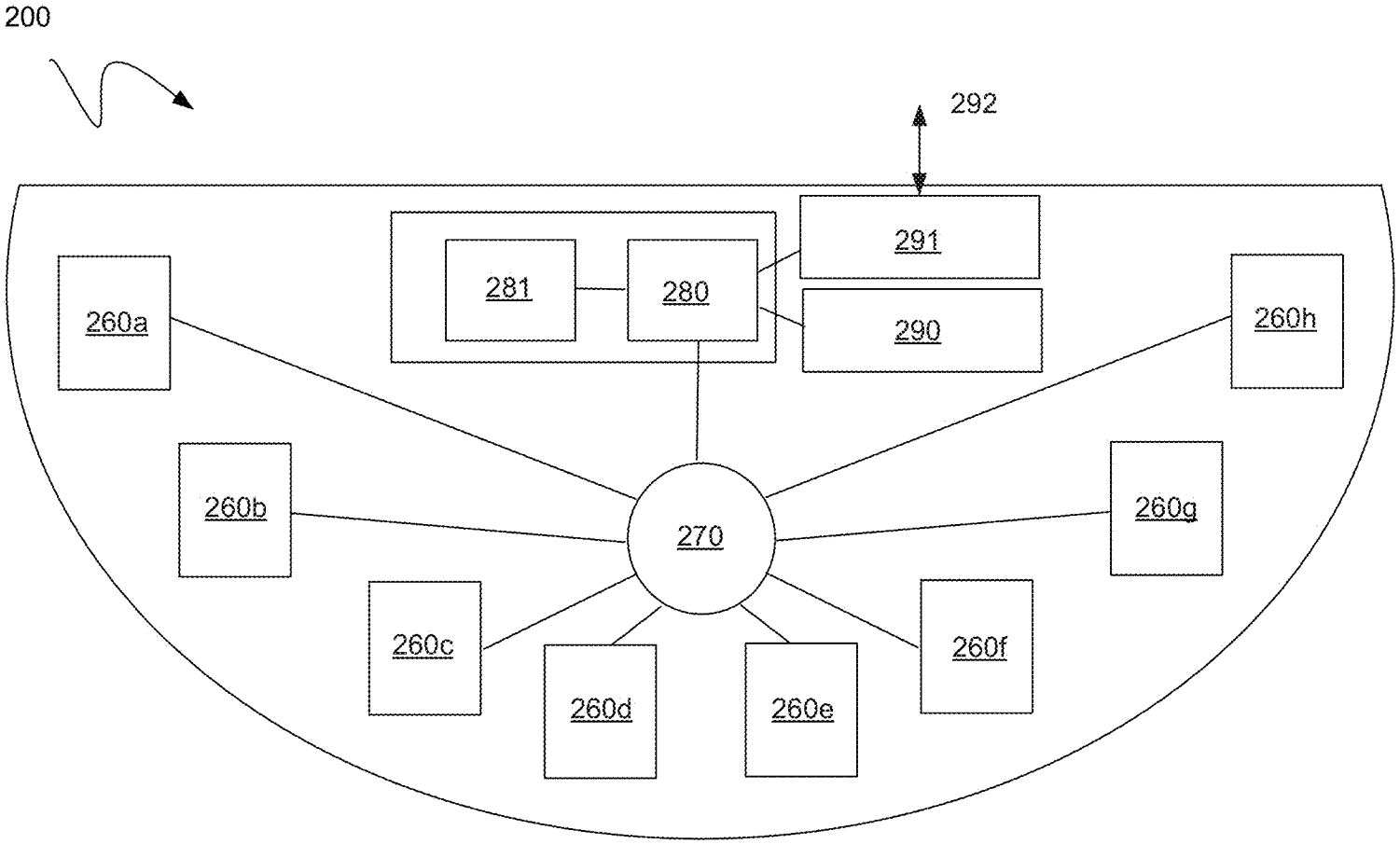
FIG. 2 illustrates in block diagram format an exemplary computing system for an electronic gaming table adapted for table games that allow many players while still permitting individual player choices according to one embodiment of the present disclosure.

Continuing with FIG. 2, an exemplary computing system for an electronic gaming table adapted for table games that allow many players while still permitting individual player choices is provided in block diagram format. Computing system 250 for an eTable can include various individual processors and peripherals 260*a*-260*k* for a plurality of player stations. In various embodiments, each of these separate items can be an identical or substantially similar set of processors, displays, inputs and other components, as may be desirable for each separate player station. As shown, some of the player stations (e.g., 260*a* through 260*h*) may be physically present at the eTable 200, while other player stations (e.g., 260*i* and 260*k*) may be located away from the eTable. Such remotely located player stations can be nearby the table and within view of the playing surface and/or an overhead display of the playing surface. In addition, one or more remotely located player stations can be located in a different room or different location entirely, such as where a video feed of the live table game can be provided to the player station for live play. Such remotely located player stations can be mobile devices, and/or can also be third party devices. Examples of third party mobile devices that could serve as a player station can include smart phones or tablet computers that are adapted to interact with the eTable and/or the associated system running games thereon.

All of the player station systems 260*a*-260*k* can couple to a central router or hub 270, which is coupled to a master table controller ("TC") having a CPU 280 and memory or storage 281. The TC can be coupled to one or more table displays 290, as well as an interface 291 for outside communications. Such table display(s) 290 can provide views of the playing surface to many more players that may be nearby the table but not in position to have a good view of the playing surface. In this manner, dozens or hundreds of players can be playing at a single table. Link 292 represents the connection to the network, so that system 250 is able to communicate with various other network or system components.

In various embodiments, a remote game server can administer some or all of the game away from the actual physical table. The remote server can have the rules of the game, and can be responsible to conduct the table game, such that the TC only conducts data acquisition. As such, the TC can be connected to the card shoe, shuffler, camera(s), dealer terminal, chip counter, overhead display(s), and so forth. In operation, the TC can collect raw data from these peripherals and then provide this data to the host game server located remotely. The remote host or game server can then provide any number of functions, such as, for example, to process the game according to game rules, store the game states, keep track of game history, resolve player hands, credit or debit player accounts, run the community display, and the like. Data from each player terminal can be collected by the table processor (i.e., TC) and forwarded to the remote server, can be sent to the remote server directly from player terminals, or some combination thereof.

In embodiments involving a remote game server, such a game server of the system may be adapted to handle multiple tables simultaneously. In such embodiments, the system can also broadcast games or action at multiple tables to each remote player terminal, thus allowing the player to watch other games and/or participate in more than one game at the same time.

In other embodiments, the TC itself can perform all of these functions during game play. In such embodiments, the eTable can be an isolated stand alone device, such as a single gaming machine or component. In some such arrangements, only final accounting results can then be forwarded to an overall casino or gaming system or other gaming network, as may be desired.

In various embodiments involving a remote server, a TC that runs most or all of the game functions, or both, the effective game controller can calculate the game results and then send such results to the live dealer for the final game decision. That is, the live dealer can be the final arbiter of the game results as provided by the appropriate game controller or processor. This redundant decision maker can assure a more robust game, as the dealer can correct game errors and make other actions before broadcasting any final game and payout results or resolutions.

In various embodiments, there may or may not be live players at the eTable. That is, in some embodiments the eTable may not have any live players sitting at the table, and rather has only the dealer, playing surface, cards and/or other live physical game components. In such embodiments, all live players may wager on and participate in the game action through remotely located game terminals. Again, such remotely located terminals may be nearby the eTable and within view of the playing surface and/or one or more community displays. For example, such nearby terminals can be within 100 feet of the eTable. Of course, further distances and/or removed locations to other rooms or properties are also possible, such as where the remotely located players can view a video of the live game action via other game terminal types such as a computer terminal, a tablet computer, a smart phone, a smart television, and the like. Such other game terminals can be mobile and/or third party devices, such as in the case of smart phones, tablets, and other similar devices.

Figure 3A:
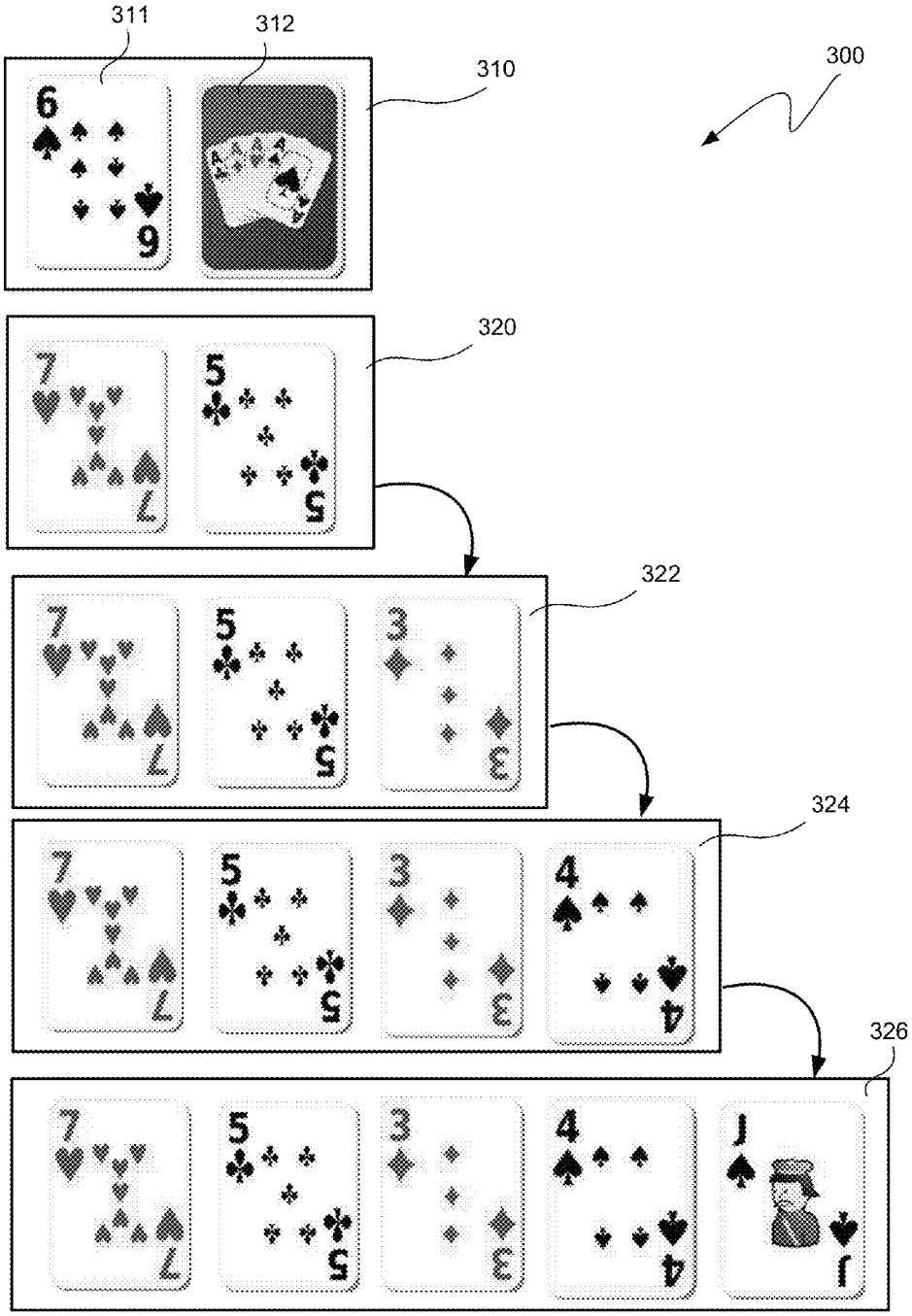
FIG. 3A illustrates in block diagram format the play of an exemplary hand allowing for different player choices from many players at an electronic gaming table according to one embodiment of the present disclosure.
Figure 3B:
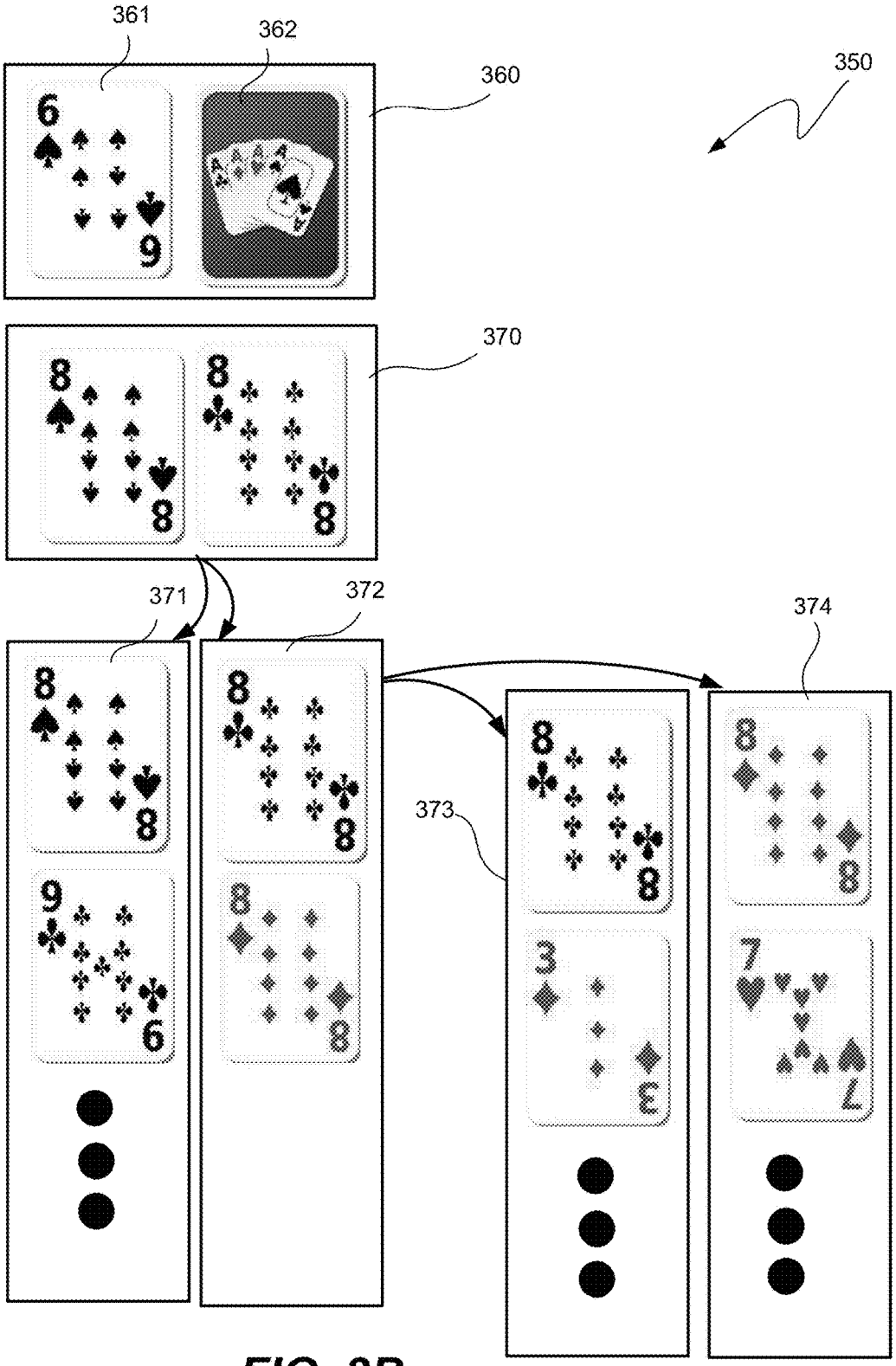
FIG. 3B illustrates in block diagram format the play of an exemplary hand allowing for different player inputs from many players for a collective decision at an electronic gaming table according to one embodiment of the present disclosure.

Turning next to FIGS. 3A and 3B, various examples are provided of game play for numerous players on a single hand where players are able to retain certain player choices that decide game outcomes. While the game of interest is blackjack in the provided examples, it will be readily appreciated that the concept and principles disclosed herein may be applied to other wagering and casino games. First, FIG. 3A illustrates in block diagram format the play of an exemplary hand allowing for different player choices from many players at an electronic gaming table according to one embodiment of the present disclosure. Exemplary blackjack hand 300 can include a single dealer hand 310 and a single player hand 320. While only a single player hand 320 is provided, it will be readily appreciated that multiple player hands can also be present, with the same principles and details set forth herein being applied to each of the different player hands. As per standard blackjack rules, wagers on the player hand 310 or hands are typically made prior to the deal of cards.

Dealer hand 310 can include a face up card 311 (e.g., the six of spades), and a face down card 312. The player hand 320 can include two cards (e.g., the seven of hearts and the five of clubs), upon which each active player can then make a choice. As will be readily understood per the standard rules of blackjack, a player may choose to "hit" or "stay" on the cards set forth in player hand 320. For purposes of illustration, Player A decides to stay, while each of Players B, C, and D decide to hit. Player A is thus frozen at a hand value of "12." The next or "hit" card (e.g., the three of diamonds) is shown in the progression at player hand 322. At this point, all players that hit the player hand 320 now have another decision whether to hit or stay. Again, for purposes of illustration, Player B decides to stay with a hand value of "15," while Players C and D decide to hit one more time.

The next or hit card (e.g., the four of spades) is shown in the next player hand progression at 324. At this point, Player C decides to stay with a player hand value of "19," while Player D decides to hit again for some reason. The final hit or "bust" card is shown as the jack of spades at player hand 326, upon which Player D automatically loses the hand. At this point, the dealer hand 310 is then played per the standard rules of blackjack. If the dealer busts, then each of Players A, B and C win the hand. If the dealer makes a final hand of 17 or 18, then only Player C wins. Of course, if the dealer makes a final hand of 20 or 21, then all players lose.

In the foregoing example, it will be readily appreciated that each of Players A, B, C and D can represent dozens or even hundreds of live and active players wagering on the same player hand 320. Each of these players is provided with the same decision ability regarding the play of the hand as noted above, and each player is provided with a final hand value and resolution against the final dealer hand according to the individual player decisions made. As will be readily appreciated, this can result in some players winning and some players losing on the same player hand. Of course, "pushes" or ties may also be attributed to some players and not others, as will be readily appreciated.

Other player choices may also be provided to each player as may be applicable. For example, the ability to take "insurance" against a dealer ace, as well as the ability to elect to "double down" may be chosen by some players but not others as these opportunities arise for a given player hand that is wagered upon and played by multiple players. Appropriate hand resolutions and monetary awards can then be calculated accordingly as to whether a given player has elected for or against insurance, or for or against doubling down, as may be applicable. For example, where one player may decide to double down and another does not, both players may wind up with the same hand value and the same win against the dealer hand. The player that elected to double down, however, would win twice his or her wager, while the other player would only win the original wager for the same hand result.

In the event of each player choice, it may be practical to provide each player with a certain amount of time to make and lock in a decision. For example, ten or fifteen seconds may suffice. Other time periods are also possible, as may be desired for a given gaming operator. In some embodiments, it may also be possible to grant each player an occasional ability to ask for more time to consider a decision. For example, once every hour or session, a player may request an extra ten or fifteen seconds to make a player decision. Of course, it may be prudent to limit all players overall, so as to maintain the pace of the game for the vast majority of players that prefer to play at a regular rate. In some embodiments, the amount of time given to a player to make a decision can vary, and different eTables can provide for fast or slow games accordingly. Players can then elect to play at a table that suits their particular game speed and preferences.

Where a player does not make any player choice within the given time allotted for such a decision, there can be an understood default selection. For example, where a player is provided with a decision to hit or stay, a no decision with the given time period can default to a "stay" decision. Other no decisions within the given time period can default to other options, as may be preferable.

As may be appreciated, however, it may not be possible or practical to provide every player choice to every player for every hand. For example, where split hands and multiple split hands may cause high complexity and bog down games, players can be provided with a collective voting ability on how the hand is to proceed rather than individual abilities to choose to split or not split hands. Other player options and choices can resort to player voting as may be appropriate or desired for a given circumstance or other types of games, as will be readily appreciated.

FIG. 3B illustrates in block diagram format the play of an exemplary hand allowing for different player inputs from many players for a collective decision at an electronic gaming table. Exemplary blackjack hand 350 can similarly include a single dealer hand 360 and a single player hand 370. Again, while only a single player hand 320 is provided, it will be readily appreciated that multiple player hands can also be present, with the same principles and details set forth herein being applied to each of the different player hands. Again, the dealer hand 360 can include one upcard 361 and one downcard 362. Player hand 370 can include a pair, which may be split per the regular rules of blackjack. As shown, a pair of 8s may be split or not split. In order to reduce game complexity where some players want to split and others do not, with a resulting mess of cards for single or multiple player hands stemming from the original pair of 8s, a collective player vote can be taken.

That is, rather than allow each player to make a player decision that affects him or her only, each player can be permitted to cast a vote as to whether the player hand should be split or not split. In some embodiments, a simple majority can then be tabulated to decide whether the hand is split or not. After the hand is split (or not), then each separate player hand can be played normally, with player hit, stay and/or double down decisions being made individually with individual consequences by each separate live player. In other embodiments, player voting can be weighted, such as by preferred players, bet size, or other criteria. For example, the collective player vote on whether or not to split (or any other collective player decision) can be granted based upon the input votes weighted by bet size. Where Player A has wagered $10 on the player hand, then 10 votes are given to the choice of Player A, but because Player B has wagered $100 on the same player hand, then 100 votes are given to the input decision of Player B.

Alternatively, a single dominant player may be the decision maker for all players at the table. For example, a player that is "banking" the house hand, or one with the largest game bet on the player hand may have the sole choice as to the decision that is made for a given instance (e.g., split or no split). In the event of equal, weighted, or other types of collective player input for a voting decision, again a time limit can be placed on all active players. In the event that no input is made by a given player by the time limit, then a default vote can be entered. Alternatively, no vote can be entered in such instances.

In the example illustrated in FIG. 3B, the collective player vote decides that the pair of 8s should in fact be split, which results in two player hands 371, 372. The first player hand 371 is given a nine of clubs, whereupon players can elect to stay or hit again. The second player hand 372, however, is given another 8, whereupon another split decision can be voted upon. Again, the collective player vote can result in another split, with player hands 373 and 374 resulting therefrom. Each of these hands is given another card (e.g., the three of diamonds and the seven of hearts), whereupon each hand is then played in turn per the standard player decision making and hand resolution as set forth above.

Figure 4:
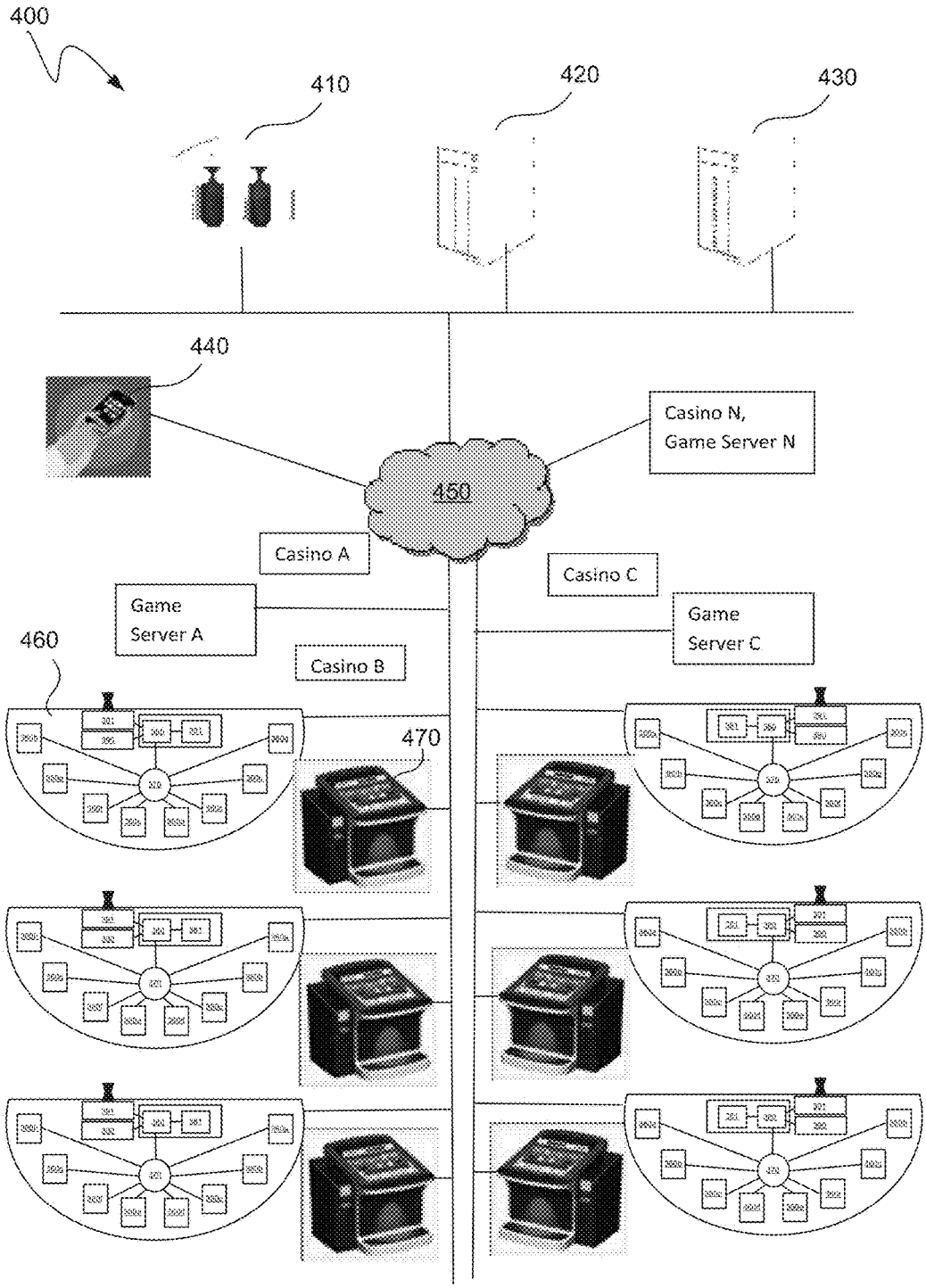
FIG. 4 illustrates in block diagram format an exemplary electronic gaming table system utilizing multiple tables such as those in FIGS. 1A, 1B and 2 according to one embodiment of the present disclosure.

Moving now to FIG. 4 an exemplary electronic gaming table system utilizing multiple tables such as those in FIGS. 1A, 1B and 2 according to one embodiment of the present disclosure is illustrated in block diagram format. Wide area system 400 can include a wide variety of components and items, such as a bank 410, a games router 420, and a financial clearinghouse 430. A cloud 450 or network can couple these items to various eTables, terminals, game servers, casinos, and other distributed components. As noted above, one or more personal devices 440 can serve as remote player terminals in some embodiments. Such personal devices can be third party and/or mobile devices, such as a smart phone, tablet computer, laptop computer, PDA, or the like. Various networked casinos, game servers, eTables 460 and other remote terminals 470 can also be coupled through the cloud 450 or network in system 400.

One or more game servers may be present in system 400, and each operates in a particular manner to facilitate the play of the various table games set forth above. In such embodiments, a game server can collect live game information from each eTable, apply game rules, and return game results. Beside monitoring and controlling the games, the game server also keeps track, in a database, of game history of each eTable, accounting information, revenue reports, maintenance information, and the like. Each of these individual functions can be performed by a separate application on a separate server, or integrated into one application running on one comprehensive server. The determination of one or multiple servers and applications depends on the number of eTables, game stations, remote gaming terminals, both local and remote, that are being connected across the system.

Each separate casino or gaming establishment can have its own one or more game servers, and each game server can be configured to serve a particular game type (e.g., baccarat, blackjack, roulette, craps, and the like), a quantity of tables or game stations, or an area of the casino. In a multi-game, multi-site environment, one important function of the game server is the handling of financial transaction from remote game terminals. In prior arts, remote game terminals are logged into a particular eTable. From there, the remote player either participate directly as if he is sitting at the table, or back bet on one of the players at the table. In system 400, however, a remote player need not be constrained to any particular physical eTable. For instance, a player sitting at a seat on a local eTable can wager on the game on going at the local table and at another table at the same casino, or at an eTable at a casino located elsewhere. These capabilities are enabled by a network of game servers, one or more games routers 420, and a central financial clearinghouse 430 for remote wagers.

Another function that can be performed by each game server across multiple establishments is the push of live game information to the game server to be broadcasted to remote gaming terminals. Here, the game server can reconstruct a live physical game in a number of ways, such as by mashing up live video feeds of the game being played at the local eTable, the digital rendition of the game pieces (cards, dice, roulette wheel, etc.), the bet options (bet board), and the like, into a composite video stream and/or digital presentation for broadcasting. In short, the live game at the eTable can be broadcast to other gaming sites like TV channels being broadcast by cable TV system to eligible subscribers. Utilizing such a design, and in separating the game presentation from the bet actions, allows many remote devices to participate in a given live table game. Again, such devices can include a remote EGM, smart phone, tablet computer, laptop, smart TV, and the like.

A games router 420 can be a match maker between a given live eTable and a remote bettor or player. In operation, games router 420 receives search requests from the various remote game stations, matches up the search requests with the available live table games in its database, and directs the multitude of live game broadcasts to their requestors and subscribers. Again, such requests for remote play can come from remote EGMs, remote terminals, remote mobile devices such as third party smart phones or tablets, remote eTable players, and so forth. The games router 420 also monitors its subscriber-base for remote wagers from the subscribers. When a remote wager is received, the games router 420 verifies the eligibility of the wager prior to allowing the remote EGM to make a wager. Such verification can be based on EGM location, rules related to that location, player ID, funds available, and other relevant criteria. Once a remote wager is accepted at the eTable, the games router notifies the financial clearinghouse, which in turn handles the wager settlement based upon the game outcome. Then the local game server that services the remote EGM is notified, such that proper revenue accounting can take place, along with an audit trail for account reconciliations and/or dispute resolutions if that becomes necessary. Games router 420 can also handle notifications to remote players regarding wins, losses, account values, and the like.

Like the financial clearinghouse of a stock market, the financial clearinghouse ("FCH") 430 can be a centralized entity that keeps track of all of the remote wagers and all of the eTable(s) and remote terminals involved. At the end of each game at each eTable, the FCH 430 settles all accounts by crediting or debiting them. Such accounts can include each live player account, each remote player account, an overall eTable account, and any other pertinent account that requires resolution. FCH 430 receives remote bets from the games router 420 and the game results (e.g., win/loss, and paytable information) from the local games server for the particular eTable 460 involved in a given game. In one embodiment, a player account can be pre-established with the FCH 430, and the FCH can credit the player account directly at the casino where he or she is playing, or at his Bank 410, if that has been arranged. In another approach, the FCH 430 sends the settlement funds directly to the player station, EGM or remote terminal where the player is actually located. This can be a preferred approach for cash players, for example.

In various embodiments, remote gaming terminals 470 can be fully robust or even thin client gaming terminals that are allowed to participate in live games remotely from eTables in the overall system. As in the case of player stations at the eTables, the remote gaming terminals can be adapted to play in multiple live games, which can be done simultaneously and where the games are different from each other. A remote game terminal 470 can be similar to a video slot machine, with all the typical peripheral devices attached such as a coin or bill acceptor, display, player tracking card reader, printer, and the like. The main difference is that it is remotely located from the live table game, is connected to the eTable system network, and receives its live game feed from a game router.

A remote gaming terminal 470 may be provided as a kiosk, an interface at an electronic gaming device or eTable, a handheld device, cellular phone, tablet, smart TV, or other device networked (locally or via the Internet, for example) to the overall system 400. A data communication device may be positioned at a gaming table and configured for receiving game play data randomly generated during play of the live table game, either through manual input or automatic input of game play information, such as the gaming symbols on the cards dealt, to the communication device. The communication device can be a PDA or smart phone 440, for example. Such a device can be at a live eTable, or can be a remote gaming terminal separate from all system eTables, similar to terminals 470.

In various embodiments, game play information may be manually input to data communication device through a manual input device such as a keypad or touchscreen. Alternatively, electronic scanning, recognition and detecting devices known in the art may be used to read cards, determine the location of a roulette ball, or ascertain the results of a dice game, and then automatically transmit the information via communication device. Game play information may also be automatically input using a camera mounted over the live table game to obtain game information, or through one or more card reading devices, such as an optical reader mounted in a gaming table, card delivery shoe, or card shuffler, which is capable of decoding the gaming symbols shown on physical playing cards. Alternatively, such as in electronic gaming platforms in which physical cards are replaced by virtual cards, the gaming data may derive from the random number generator used to generate random virtual cards.

The data communication device receives and transmits game play data, which can be live or randomly generated as a result of playing the live table game. Processing device facilitates comparing the game play data with the rules and/or criteria for winning the wagers stored in data storage device, and determining an outcome of the wagers placed on the live table game via a data communication device of gaming terminal 470. If the criteria are satisfied, then the wager is won, whereas if the criteria are not satisfied the wager is lost. A display device at the gaming terminal 470 can be configured to facilitate the entry of wagers, show a live multimedia feed of the table game being played and communicate the outcome of any wagers placed.

As one example, system 400 may be configured to provide the option for a player to enter remotely into a live conventional blackjack game through an eTable 460 or remote gaming terminal 470. A player using gaming terminal 470 may choose to participate in the live blackjack game or play another remote blackjack game in which the rules are different, such as the rules for dealing cards to reveal their value, or rules relating to the wager size (minimum, maximum, increment), or rules relating to payout associated with game symbols and symbol combinations, or rules allowing for a wild card, or in a blackjack variant in which the rules differ in any way from conventional blackjack. The cards dealt in the live game can be correlated by system 400 with the cards to be received in the remote wagering game according to its rules in order to resolve all wagers placed in the remote wagering game.

System 400 may be configured to be responsive to an additional request for randomly generated game play data, which may be necessary for resolving a remote wagering game played by a remote player. For example, system 400 may inform the dealer at the live table game through a communication device or display 140 to continue to deal a certain number of randomly shuffled cards above the amount needed to resolve the live table game, or system 400 may be in communication with a random number generator for the purpose of generating any amount of random gaming symbols necessary to match the amount necessary in the remote wagering game or add on to the random gaming symbols acquired from the live table game.

In another example, system 400 is configured to provide the option for a player to enter into a live conventional blackjack or play a remote blackjack game which includes one or more side wagers. Players may place the side wager through a player station at an eTable 460 or remote gaming terminal 470. Either live game component results and/or randomly generated gaming symbols received via a communication device can be compared via appropriate system processing, with criteria for determining the outcome of the side wager the determining whether the game outcome is favorable or negative. If favorable, then the side wager will be won and the player appropriately credited.

For example, a remote blackjack game may allow for the player to wager on receiving a hand that has achieved a poker rank such as a pair. The physically dealt cards and/or randomly generated gaming symbols dealt in the live conventional blackjack game are received and compared with the criteria that the gaming symbols corresponding to the player's hand in the remote blackjack game comprise two cards of the same rank. In yet another example, the game of baccarat may be played live and broadcast to player terminal 470, along with various remote baccarat variant games that include different rules, such as no-commission versions, variations on pay tables, or which include additional side wagers, which may include progressive side wagers, mystery jackpots or bonuses. Thus, players at a player station at an eTable 460 or remote gaming terminal 470 are capable of participating in many variations of baccarat games with the same hand delivered in the live table game.

Players may therefore have a variety of options to play other wagering games than the live table game. However, system 400 may be configured so that only the remote wagering games that rely on the same amount or plurality of gaming symbols, or game variations that belong to the same game families (variations of Baccarat, Roulette, Sic-Bo, and the like) as those gaming symbols which are physically determined and/or randomly generated in the live table game are offered as available to players through the actual eTable.

System 400 may be configured to provide a simulation of the remote wagering game wager on by players using a player station or remote gaming terminal. The simulation may be presented on a suitable display according to the rules of the remote wagering game and may take any form, such as a display of playing cards being dealt by a virtual dealer or the actual dealer in the live table game, which would enhance the overall player experience. System 400 may be configured to provide a new display or skin on a display device of a station or gaming terminal and provide customized playing cards for the remote wagering games to distinguish between games and provide proprietary information, among other things. Variations in game rules, wager size and pay tables affecting payout amounts and volatility that are different from that of the live table may also be applied to the games at the remote game terminals to provide a favorable personalized player experience.

Figure 5:
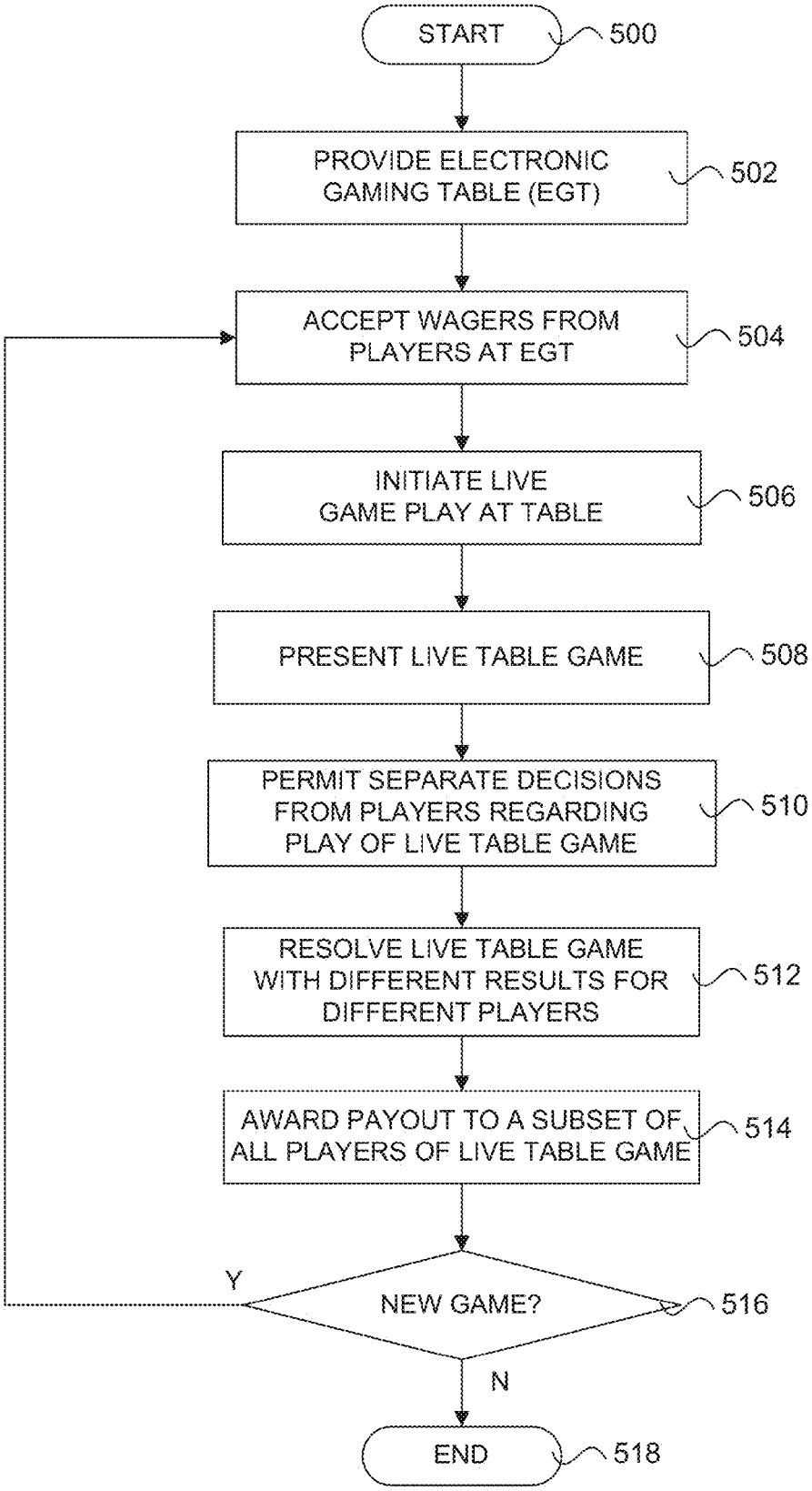
FIG. 5 provides a flowchart of an exemplary method of providing a live table game allowing choices from numerous players for a single game according to one embodiment of the present disclosure.
Figure 6:
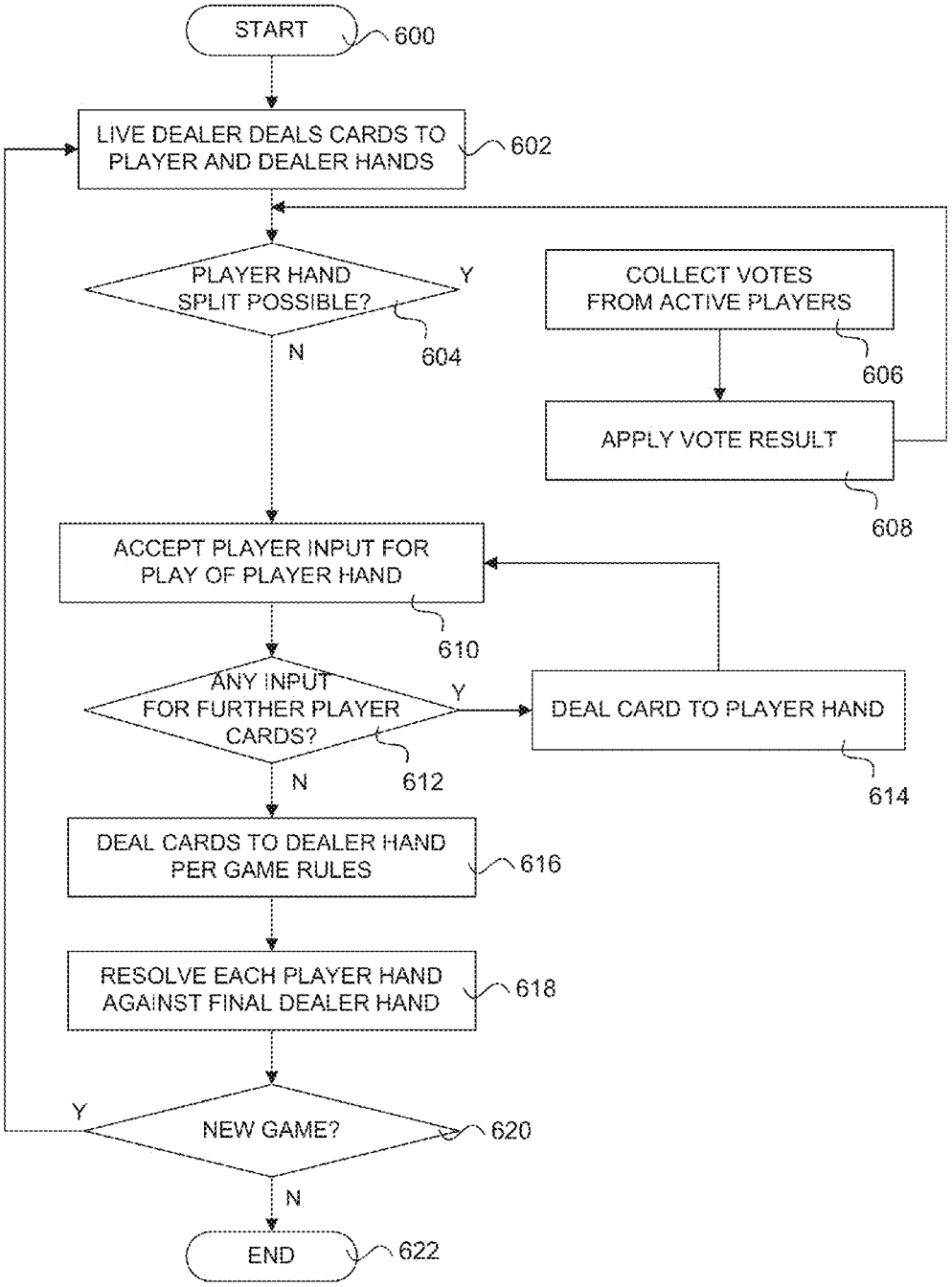
FIG. 6 provides a flowchart of an exemplary method of playing a live table game according to one embodiment of the present disclosure.

Turning now to FIGS. 5 and 6, various methods of providing player choice games for multiple players on a single table are illustrated. FIG. 5 provides a flowchart of an exemplary method of providing a live table game allowing choices from numerous players for a single game. After a start step 500, an electronic gaming table EGT is provided at process step 502. Such an EGT can be that which is set forth above for example. Monetary value and wagers from players are accepted at player station or other gaming terminals at process step 504. Again, this can be at a player station at an eTable or EGT, at a remote terminal, or at any remote playing device. The monetary value can be by way of coins, bills, cards, or other acceptable cash or valuable credit offered by the player. The monetary value can be validated and sent to the TC of the respective eTable for which a game is to be played at process step 504.

At a following step 506, a live game play can be initiated at the EGT or eTable. This can be done by a live dealer starting to play a game with the appropriate physical components, which can be cards, dice, wheels, chips, tokens, and the like. The TC at the EGT can process the live game play data, and the live table game is presented at subsequent process step 508. Separate decisions from different players can then be permitted at process step 510, after which the live table game is resolved at process step 512. Resolution of the game can result in different outcomes or results for different players based upon the separate decisions from step 510, which separate decisions may or may not be identical for all players.

Payouts can be awarded to players at the following process step 514 according to the resolution of step 512. In some instances, this can result in payouts to some players, but no payouts to other players. For example, where some players have busted but other players have stayed and the dealer hand has busted, then the staying players receive payouts while the busted players receive none. An inquiry is made at decision step 516 as to whether a new game is desired. If so, then the method reverts to process step 504 and the entire process from that point is repeated. If not, then the method ends at end step 518.

FIG. 6 provides a flowchart of an exemplary method of playing a live table game according to one embodiment of the present disclosure. After a start step 600, then the live dealer can deal starting cards to the player and dealer hands at process step 602. At a following decision step 604, an inquiry is made as to whether a player hand split is possible. If so, then the method moves to process step 606, where votes are collected from the active players. The vote result is applied at process step 608, and the process reverts back to decision step 604 to inquire if any further splits are possible. In the event that no splits are possible, then the method continues to process step 610, where individual player inputs are accepted for the play of the player hand. For example, each player can be provided with a choice as to whether to stand, hit or double down. At subsequent decision step 612, an inquiry is made as to whether any further player input is possible. If so, then a card is dealt to the player hand at process step 614, and the method reverts to process step 610 for further player inputs from those players that chose to hit or otherwise proceed. This process is repeated until no further hits or possible or no player chooses to hit, upon which the method then moves to process step 616.

At step 616, the dealer then deals cards to the dealer hand per the regular rules of blackjack. Each player hand is then resolved at process step 618 per the decisions that each player made previously and the result of the dealer hand. Any payouts are made as may be required as well. An inquiry is then made at the following decision step 620 as to whether another game is desired. If so, then the method reverts back to process step 602 and the entire process is repeated. If no further hands are desired, however, then the method ends at end step 622.

For both of the foregoing flowcharts and methods, it will be readily appreciated that not every method step provided is always necessary, and that further steps not set forth herein may also be included. For example, added steps to involve additional eTables or third or more live table games may be added. Furthermore, the exact order of steps may be altered as desired for various applications, and some steps may be performed simultaneously. In addition, while the provided examples are with respect to blackjack, it will be readily understood that other casino and wagering games can be similarly adapted to provide player choices in a similar manner.

It should be understood that the devices, systems and methods described herein may be adapted and configured to function independently or may also interact with other systems or applications, such as for example, a casino management system or player tracking system. As such, the wagering data may be recorded and stored in connection with player information retrieved from the terminal. It should also be readily apparent that additional computerized or manual systems may also be employed in accordance with the disclosure in order to achieve its full implementation as a system, apparatus or method.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as an existing electronic gaming machine, portable computing device or electronic platforms with multiple player positions. In addition, the system of the disclosure may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the disclosure so long as players and operators thereof are provided with useful access thereto or the opportunity to play the game as described herein.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A gaming system comprising:

an electronic gaming table including:

(a) a physical surface adapted for a play of a live table game that includes use of a live dealer and one or more physical game components;

(b) a dealer station situated proximate to said physical surface and configured to enable live dealer to facilitate the play of said live table game;

a plurality of player terminals situated at or nearby the electronic gaming table, wherein each of said plurality of player terminals enables a player to participate in the play of the live table game and includes a player terminal processor configured to operate with a player interface including one or more player input devices and one or more player output devices; and a table controller configured to operate with said plurality of player terminals and the electronic gaming table, to:

(a) administer a live table game pitting a dealer hand against a shared player hand, wherein the shared player hand is shared by the player of each of the plurality of player terminals who each play the shared player hand against the dealer hand, (b) if a collective decision condition is satisfied in association with the shared player hand:

(i) receive a collective game decision;

(ii) enable each of the players to make one or more live game decisions regarding the shared player hand, wherein the one or more live game decisions are each independent of other players and are based, at least in part, on the received collective decision; and (iii) resolve the play of the live table game for each player depending upon the one or more live game decisions of each player playing the shared player hand against the dealer hand; and (c) if no collective decision condition is satisfied:

(i) enable each of the plurality of players to make one or more live game decisions regarding the shared player hand, wherein the one or more live game decisions are each independent of other players, and (ii) resolve the play of the live table game for each player depending upon the one or more live game decisions of each player playing the shared player hand against the dealer hand.

2. The gaming system of claim 1, wherein at least one of the one or more live game decisions takes place after the initial creation of the dealer hand and the player hand.

3. The gaming system of claim 1, wherein at least one of the one or more live game decisions occurs after initial wagers are placed and initial physical game components creating the dealer hand and the player hand have been distributed.

4. The gaming system of claim 1, wherein at least one of the live game decisions involves a strategic decision on the play of the shared player hand that is separate from placing wagers or wager amounts.

5. The gaming system of claim 1, wherein the dealer hand and the shared player hand are the only two hands in the play of the live table game.

6. The gaming system of claim 1, wherein the live table game is a game of blackjack.

7. The gaming system of claim 6, wherein at least one of the live game decisions involves a decision on whether to hit or stay with the shared player hand.

8. The gaming system of claim 7, wherein a first player of the play of the live table game independently decides to hit with the shared player hand while a second player of the play of the live table game independently decides to stay with the shared player hand, and wherein one of the first player and the second player wins with the shared player hand against the dealer hand based on his or her independent decision to hit or stay while the other of the first player and the second player loses with the shared player hand against the dealer based on his or her independent decision to hit or stay.

9. The gaming system of claim 6, wherein at least one of the collective game decisions involves a decision on whether to split or not split with the shared player hand.

10. The gaming system of claim 1, wherein the live table game is a game of pai gow.

11. The gaming system of claim 1, wherein the table controller is further configured to interact with one or more third party electronic devices as added virtual player terminals for additional players to participate in the play of the live table games.

12. The gaming system of claim 11, wherein said one or more third party electronic devices include at least one mobile device.

13. The gaming system of claim 1, wherein the collective game decision is determined by a collective player vote.

14. The gaming system of claim 1, wherein the collective game decision is determined by a single dominant player.

15. An electronic gaming table system, comprising:

one or more electronic gaming tables, each electronic including:

(a) a physical surface adapted for a play of a live table game that includes use of a live dealer and one or more physical game components, and (b) a dealer station situated proximate to said physical surface and configured to enable the live dealer to facilitate the play of said live table game, a plurality of player terminals situated at or nearby the electronic gaming table, wherein each of said plurality of player terminals enables a player to participate in the play of the live table game and includes a player terminal processor configure to operate with a player interface including one or more player input devices and one or more player output devices, a table controller configured to operate with said plurality of player terminals, each of the one or more electronic gaming tables, and at least one interface in communication with one or more gaming system components remotely located from said one or more electronic gaming tables, to:

(a) administer a live table game pitting a dealer hand against a shared player hand, wherein the shared player hand is shared by the player of each of the plurality of player terminals who each play the shared player hand against the dealer hand, (b) if a collective decision condition is satisfied in association with the shared player hand:

(i) receive a collective game decision;

(ii) enable each of the players to make one or more live game decisions regarding the shared player hand, wherein the one or more live game decisions are each independent of other players and are based, at least in part, on the received collective decision; and (iii) resolve the play of the live table game for each player depending upon the one or more live game decisions of each player playing the shared player hand against the dealer hand; and (c) if no collective decision condition is satisfied:

(i) enable each of the plurality of players to make one or more live game decisions regarding the shared player hand, wherein the one or more live game decisions are each independent of other players, and (ii) resolve the play of the live table game for each player depending upon the one or more live game decisions of each player playing the shared player hand against the dealer hand, and a host server located remotely from and in communication with each of said one or more electronic gaming tables, said host server configured to facilitate the processing of transactions with respect to the play of the live table game played at said one or more electronic gaming tables.

16. The electronic gaming table system of claim 15, wherein at least one of the one or more live game decisions takes place after the initial creation of the dealer hand and the player hand.

17. The electronic gaming table system of claim 15, wherein the live table game is a game of blackjack.

18. The electronic gaming table system of claim 17, wherein at least one of the one or more live game decisions of the game of blackjack involves a decision on whether to hit or stay with the shared player hand.

19. The electronic gaming table system of claim 18, wherein a first player of the game of blackjack independently decides to hit with the shared player hand while a second player of the game of blackjack independently decides to stay with the shared player hand, and wherein one of the first player and the second player wins with the shared player hand against the dealer hand based on his or her independent decision to hit or stay while the other of the first player and the second player loses with the shared player hand against the dealer based on his or her independent decision to hit or stay.

20. The electronic gaming table system of claim 15, wherein at least one of the live table games is a came of pai gow.

21. The electronic gaming table system of claim 15, wherein at least one of the table controllers is further configured to interact with one or more third party electronic devices as added virtual player terminals for additional players to participate in the play of the live table games.

22. The electronic table gaming system of claim 15, wherein the collective game decision is determined by a collective player vote.

23. The electronic table gaming system of claim 15, wherein the collective game decision is determined by a single dominant player.

24. A gaming table comprising:

a physical surface adapted for a play of a live table game that includes use of a live dealer and one or more physical game components;

a dealer station situated proximate said physical surface and configured to enable the live dealer to facilitate the play of said live table game;

a plurality of player stations situated at or nearby the gaming table, wherein each of said plurality of player stations enables a player to participate in the play of live table game; and a controller configured to operate with said plurality of player stations, to:

(a) administer a live table game pitting a dealer hand against a shared player hand, wherein the shared player hand is shared by the player of each of the plurality of player stations who each play the shared player hand against the dealer hand, (b) if a collective decision condition is satisfied in association with the shared player hand:

(i) receive a collective game decision;

(ii) enable each of the players to make one or more live game decisions regarding the shared player hand, wherein the one or more live game decisions are each independent of other players and are based, at least in part, on the received collective decision; and (iii) resolve the play of the live table game for each player depending upon the one or more live game decisions of each player playing the shared player hand against the dealer hand; and (c) if no collective decision condition is satisfied:

(i) enable each of the plurality of players to make one or more live game decisions regarding the shared player hand, wherein the one or more live game decisions are each independent of other players, and (ii) resolve the play of the live table game for each player depending upon the one or more live game decisions of each player playing the shared player hand against the dealer hand.

25. The gaming table of claim 24, wherein the collective game decision is determined by a collective player vote.

26. The gaming table of claim 24, wherein the collective game decision is determined by a single dominant player.

* * * * *